US005339590A

United States Patent [19]

Kangas

[11] Patent Number: 5,339,590

[45] Date of Patent: Aug. 23, 1994

[54] TRAPEZIUM-SHAPED AQUEOUSLY-SWELLING CONCRETE JOINT-SEALING METHOD

[75] Inventor: William W. Kangas, Mundelein, Ill.

[73] Assignee: American Colloid Company, Arlington Heights, Ill.

[21] Appl. No.: 8,736

[22] Filed: Jan. 25, 1993

[51] Int. Cl.[5] ..... E04B 1/62; F02D 29/16; E04G 21/02

[52] U.S. Cl. ..... 52/396.02; 52/169.14; 52/741.4; 52/743

[58] Field of Search ..... 52/396, 169.14, 368, 52/376, 741.4, 743; 404/47, 49, 74

[56] References Cited

U.S. PATENT DOCUMENTS

| | | | |
|---|---|---|---|
| 908,780 | 1/1909 | Lang . | |
| 1,559,749 | 11/1925 | Hall | 52/368 |
| 3,979,846 | 12/1990 | Hill et al. | 52/396 |
| 4,279,547 | 7/1981 | Clem . | |
| 4,344,722 | 8/1982 | Blais . | |
| 4,366,284 | 12/1982 | Ishido et al. . | |
| 4,467,015 | 8/1984 | Clem . | |
| 4,501,788 | 2/1985 | Clem . | |
| 4,534,925 | 8/1985 | Harriett . | |
| 4,534,926 | 8/1985 | Harriett . | |
| 4,558,875 | 12/1985 | Yamaji et al. | 52/169.14 |
| 4,601,604 | 7/1986 | Clark et al. | 52/396 |
| 4,634,925 | 1/1987 | Ieki . | |
| 4,656,062 | 4/1987 | Harriett . | |
| 4,668,724 | 5/1987 | Harriett . | |
| 4,733,513 | 3/1988 | Schrader et al. | 52/396 |
| 4,733,989 | 3/1988 | Harriett . | |
| 4,774,795 | 10/1988 | Braun | 52/396 |
| 4,787,780 | 11/1988 | Harriett . | |
| 4,810,573 | 3/1989 | Harriett . | |
| 4,997,695 | 3/1991 | Clem . | |
| 5,092,091 | 3/1992 | Hull et al. | 52/396 |
| 5,197,250 | 3/1993 | Kramer | 52/396 |

FOREIGN PATENT DOCUMENTS

461901A2 12/1991 European Pat. Off. .

*Primary Examiner*—Carl D. Friedman
*Assistant Examiner*—Christopher Todd Kent
*Attorney, Agent, or Firm*—Marshall, O'Toole, Gerstein, Murray & Borun

[57] ABSTRACT

A shaped, water-expandable water-sealing article used for sealing an area between a first section of at least partially cured concrete and a second, adjacent section of substantially uncured concrete. The clay water sealing article is in the shape of a quadrilateral, preferably a trapezoid, and is disposed to bridge an area between the two sections of concrete. Upon hydration of the clay contained within the shaped water sealing article, expansion of the clay creates expansion forces extending from a corner of the article that is surrounded by the uncured concrete, wherein the corner has an included angle greater than 90°, preferably at least 100°. The expansion force developed by the expansion of the shaped water sealing article are absorbed by a substantially increased area of the uncured concrete as compared to expansion forces resulting from a clay-based water seal having a 90° included angle at the corner(s) surrounded by the uncured concrete.

17 Claims, 2 Drawing Sheets

TRAPEZIUM-SHAPED AQUEOUSLY-SWELLING CONCRETE JOINT-SEALING METHOD

FIELD OF THE INVENTION

The present invention relates to a shaped waterproofing article containing a water-swellable clay, such as sodium bentonite, for constructing and waterproofing concrete joints. More specifically, the present invention is directed to a shaped water-swellable clay-containing water seal article and a method of waterproofing wherein the article is disposed in contact with a first section of partially or completely cured concrete, and then another concrete section is poured adjacent to the first concrete section such that the shaped article bridges the two concrete sections and is capable of swelling to prevent water seepage between the concrete sections.

BACKGROUND OF THE INVENTION

In constructing various structures with cement compositions, e.g., concrete, it is often necessary to seal, or waterproof, the joints between adjacent sections of concrete.

For example, water seals typically are used, in the construction of concrete sections, where concrete joints become necessary. Such water seals are common between two preformed or precured concrete sections, or at a joint between one precured or partially cured concrete section and a concrete section being poured. More specifically, waterproofing articles for sealing concrete joints, for example, may be used during construction of the following structures: precast concrete wall systems; septic tanks and sewage treatment plants; sanitary and storm sewer manholes; pipe, including round, oval, flatbase, elliptical and arch types; cold joints in foundation slabs or walls below grade; burial and utility vaults; wet wells; box culverts; waste water treatment plants; and portable water tanks. A functional waterproofing seal should provide a complete water barrier to prevent water infiltration.

Joints between adjacent concrete sections, such as those used during the construction of the above-mentioned structures, may be made as socket-and-plug or male-female type joints. These joint types sometimes are particularly problemsome in providing a complete waterproof seal due to insufficient dimensional accuracy, improper field work at the construction site, and/or uneven settling of the land on which the concrete structure is placed.

When a water-expandable waterproofing composition is disposed to bridge the joint between (a) a cured or partially cured section of concrete and (b) a newly poured concrete section, being poured adjacent to the cured or partially cured concrete section, expansion of the waterproofing composition results in forces against one or both of the concrete sections from the expanding waterproofing composition. The shaped waterproofing composition of the present invention minimizes the stress and/or expansion forces exerted against one or both of the adjacent concrete sections from the expanding waterproofing article.

Another substantial problem frequently encountered when using a water-expandable, waterproofing article to seal a joint between two concrete sections is that the waterproofing article can be deformed or displaced from its intended position at the joint. Deformation and/or displacement can result since the waterproofing article is formed from a composition that is relatively soft and can be deformed and/or displaced easily upon impact from concrete being poured onto the composition. For example, when a water seal article is placed on an upper surface of a first concrete section that is at least partially cured, and a second concrete section is newly poured adjacent to the first concrete section, the falling concrete that impacts the water seal article oftentimes forces the article out of place, so that the article no longer bridges the two concrete sections completely along this joint.

A useful water seal article should have additional beneficial qualities. Such a seal should be useful in all environmental temperatures encountered at the installation location without becoming too stiff and brittle in cold temperatures, and without becoming so soft at higher temperatures that the composition blows by gravity and is thereby displaced from its intended location. Also, the seal should remain flexible over time without shrinking, substantial hardening or oxidizing-Further, a water seal article should be safe to use.

Bentonire clay, particularly sodium bentonire, often has been used in waterproofing applications, including foundation waterproofing, due to its known ability to expand, upon hydration, to fill areas of potential water flow. Bentonire clay swells to many times its non-hydrated volume when it comes into contact with water, forming a water-impenetrable clay layer that protects an adjacent structure. The hydrated clay composition expands sufficiently to seal relatively large seams or joints between concrete sections as well as relatively small cracks in concrete.

Installing water seals in concrete joints has been a time consuming and labor-intensive part of concrete construction. Therefore, a useful seal should not only allow for a complete, quality seal between concrete sections, but it should be capable of relatively easy and cost-efficient installation.

The water seal of the present invention satisfies all of the criteria set forth above.

SUMMARY OF THE INVENTION

In brief, the present invention is directed to a shaped water-swellable clay-containing water sealing article used for sealing an area between a first section of at least partially cured concrete and a second, adjacent section of substantially uncured concrete. The clay water sealing article of the present invention is in the shape of a quadrilateral, preferably a trapezoid, and is disposed to bridge an area between a section of at least partially cured concrete and a newly poured, substantially uncured section of concrete. Upon hydration of the clay contained within the shaped water seal article, expansion of the clay creates forces upon the adjacent concrete section(s)- The expansion forces extend from a corner of the waterproofing article that is surrounded by the uncured concrete, wherein the corner has an included angle greater than 90°. The concrete forces, resulting from the expansion of the shaped water seal article of the present invention, are applied to a substantially increased area as compared to forces resulting from a clay-based water seal article having a 90° included angle at the corner(s) surrounded by the uncured concrete.

Accordingly, an aspect of the present invention is to provide a shaped water-swellable clay-containing water seal article that contains at least about 20% by weight of a water-swellable bentonire clay, such as sodium bentonire, for sealing an area between two concrete sections, one cured, and an adjacent, substantially uncured concrete section, while minimizing forces applied against any uncured concrete surrounding the shaped waterproofing article.

Another aspect of the present invention is to provide adjacent, water sealed concrete sections including a first section of at least partially cured concrete; a second section of substantially uncured concrete; and an elongate strip of a bentonire clay-containing water seal article, located between the two sections, said article having a vertical cross-sectional area defining a quadrilateral, having at least one uncured concrete-surrounded corner, said uncured concrete surrounded corner having an included angle greater than 90° and, preferably, at least 100°

Still another aspect of the present invention is to provide a method of waterproofing an area of potential water leakage, between concrete sections, with a clay water seal strip having a vertical cross-sectional shape, perpendicular to a longitudinal axis of the strip, in the shape of a trapezium, preferably a trapezoid.

A further aspect of the present invention is to provide a method of waterproofing an area of potential water leakage between adjacent sections of concrete comprising forming a first section of at least partially cured concrete, disposing the clay water seal material in contact with the concrete, and then pouring a second section of substantially uncured concrete onto an upper surface of the water seal material, wherein the clay water seal has a vertical cross-sectional shape of a trapezium, preferably a trapezoid, disposed between the two concrete sections and bridging the area of potential water leakage.

Other aspects, features and advantages are inherent in the articles and methods as claimed and disclosed or will become inherent to those of ordinary skill in the art in view of the detailed description of the preferred embodiments, which is made with reference to the drawing, a brief description of which is provided below.

DETAILED DESCRIPTION OF THE PREFERRED EMBODIMENTS

Figure 1:
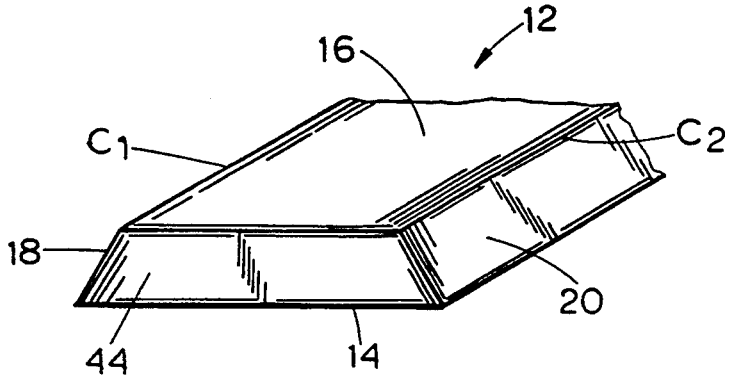
FIG. 1 is a partially broken-away perspective view of the shaped water-sealing article of the present invention, in the form of an elongate trapezoid.

In accordance with the present invention, a shaped water-swellable clay water sealing article, containing at least about 20% by weight of a water-swellable bentonire clay, is used for sealing an area between an at least partially cured concrete section and a section of substantially uncured concrete. Preferably, the uncured concrete section is poured above, or horizontally adjacent to, and in contact with the cured or partially cured concrete section. The clay water sealing article of the present invention is in the shape of a quadrilateral having, at most, two parallel surfaces, preferably in the shape of a trapezium, and more preferably in the shape of a trapezoid, to minimize forces acting on a surrounding uncured concrete section as a result of expansion of the water seal article. Upon hydration of the water seal article, expansion forces against the newly poured concrete section extend upwardly and outwardly from the corner(s) of the water seal article surrounded by the newly poured concrete.

The corner(s) (defined by an intersection of a side surface and an upper surface of the clay seal article) of the water seal article of the present invention that are surrounded by the freshly poured concrete should have an included angle greater than 90°, preferably about 100° to about 150°, e.g., about 110° to about 140°, and most preferably about 130°. The expansion forces developed using the shaped water seal article of the present invention are absorbed over a substantially larger concrete area (the forces are projected at a more upward angle, and, therefore, traverse more concrete over a substantially increased area) as compared to the expansion forces that result from a clay-based water seal having a 90° angle at the uncured concrete-surrounded corner(s).

In one preferred embodiment of the feature described in the preceding paragraph, an expansion force passing through the uncured concrete, defined by the water seal expansion forces, and a plane perpendicular to a planar lower surface of the water seal article that passes through an upper corner(s) surrounded by uncured concrete (defined by the intersection of a side surface of the article and the upper surface of the article), form an angle of less than 45°.

The shaped water sealing article of the present invention can have a number of shapes while increasing the quantity of concrete that fields the expansion forces of an expandable water seal article, so long as one or both upper, elongate corners of the article that contact uncured concrete have an included angle greater than 90°, preferably 100° or greater. As shown in the drawings, the shaped article 10 can be in the form of a trapezium (FIG. 2), having no parallel upper, lower and side surfaces; or the article 12 (FIG. 1), preferably, is in the shape of a trapezoid having planar, horizontal upper (top) and lower (bottom) surfaces.

Referring now specifically to FIG. 1, the trapezoidally-shaped water seal article 12 includes a base or bottom planar surface 14 for adherence to a planar surface, e.g., of another, cured concrete section, preferably having a width of about ¾ to about 2 inches, most preferably about 1.25 inches; a parallel, horizontal upper surface 16 having a width of about 0.5 to about 1.0 inch, e.g. preferably about 0.7 inch wide; and two side surfaces 18 and 20 having a vertical height of about 0.25 to about 1 inch, preferably about 0.5 inch, disposed at an included angle of about 30° to about 80° from the horizontal lower surface 14, to provide an included angle of about 100° to about 150° at the corners $C_1$ and $C_2$ defined by the intersection of side surfaces 18 and 20, respectively, with the upper surface 16. A scrim or netting material 22 preferably is secured to and is coextensive with the upper surface 16 for better securement of concrete nails driven vertically through the article 12 from the upper surface 16. Alternatively, the water seal article 12 can be adhesively secured using an adhesive, without the netting material 22, to prevent displacement of the water seal article while pouring an additional concrete section thereover.

Figure 2:
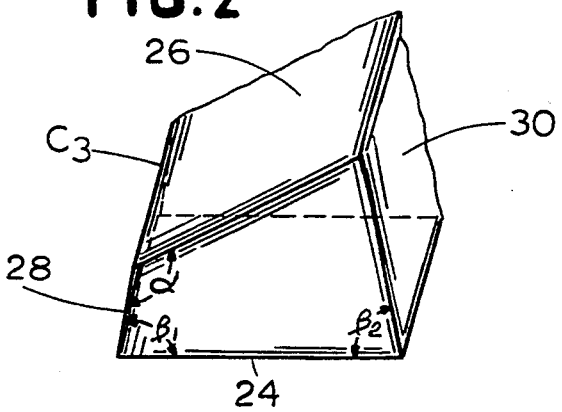
FIG. 2 is a partially broken-away perspective view of the shaped water-sealing article of the present invention, in the form of an elongate trapezium.

Referring to FIG. 2, the shaped water seal article has a cross section in the shape of a trapezium including a planar, horizontal base or lower surface 24, an upper surface 26, and two non-parallel side surfaces 28 and 30 to provide a single, uncured concrete-contacting corner $C_3$ having an included angle $\alpha$, as defined with reference to FIG. 1, preferably about 130°.

The clay water seal preferably includes about 35% to 90% by weight water-swellable bentonire clay, such as sodium bentonire, about 10% to 65% by weight polypropene, polybutene, or mixture thereof, and optionally about 1% to about 20%, e.g., about 5% by weight of an elastomer, such as partially cross linked butyl rubber. Examples of compositions useful in forming the clay water seal articles of the present invention include, for example, the compositions disclosed in U.S. Pat. Nos. 4,534,925; 4,534,926; and 4,787,780, all of which are incorporated herein by reference. The clay seal is made of a non-toxic material, requiring no special handling equipment and does not contain any material that discolors or irritates the skin.

Figure 3:
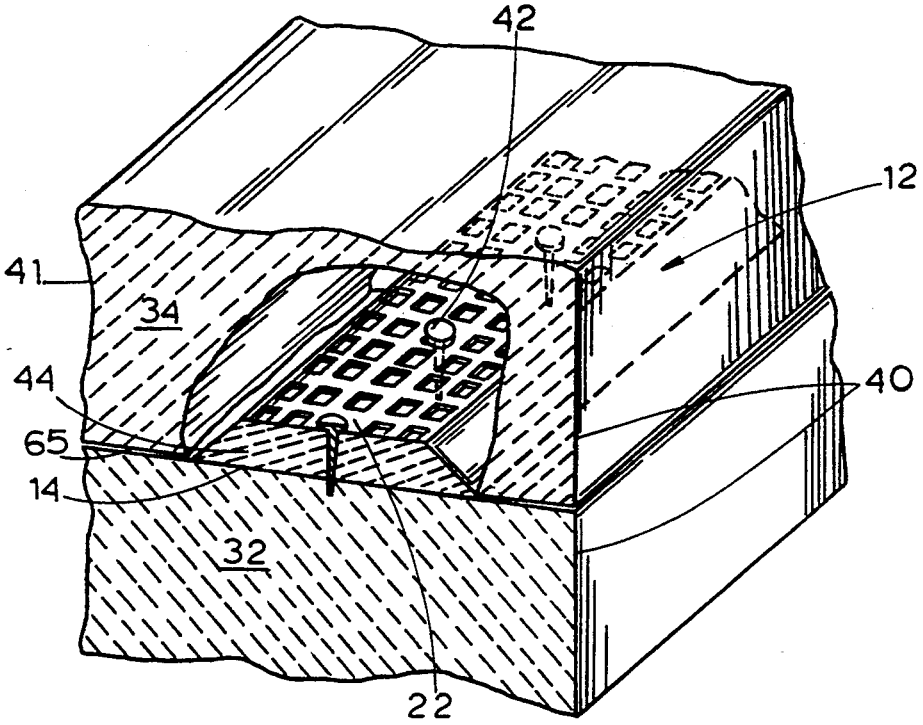
FIG. 3 is a partially broken-away perspective view showing the trapezoidally shaped water-sealing article of FIG. 1 disposed between two vertically aligned concrete sections.

As shown in FIG. 3, the water seal article, e.g., 12, is disposed such that the planar, lower surface 14 overlies an at least partially cured lower concrete section 32, and an uncured concrete section 34 then is poured onto the lower concrete section 32, over the article 12. The at least partially cured concrete section 32 may be disposed underneath and in contact with the uncured, second concrete section 34, or the sections 32 and 34 may be laterally disposed with the water sealing article 12 disposed along an interface of the two sections 32 and 34.

The water-swellable clay-containing water seal article of the present invention preferably is in the form of a flexible strip and is easily and efficiently installed by a single laborer. The seal may be supplied in the form of a coiled elongate strip that is unwound when applying the article between adjacent concrete sections. No split forming or splicing is required as may be required with other waterstop articles.

Preferably, the clay-containing water seal article of the present invention is adhered to the butt end of an at least partially cured section of concrete 32 and, preferably, is positioned a minimum of 2 inches from the exterior joint surface (i.e, there should be a minimum of 2 inches of concrete separating the water-swellable clay-containing sealing article 10 or 12 from the exterior sides 40 and 41 of the joint--See FIG. 3). The article 10 or 12 preferably is nailed or adhesively secured to the cured concrete section 32, e.g., using concrete nails 42, before pouring the second concrete section 34. Nailing down the clay seal in this manner will aid in preventing displacement of the clay seal during pouring of the concrete 34. Preferably, an end surface 44 of the article 12 should abut an end of a previously placed strip, and the strips should not overlap.

Figure 4:
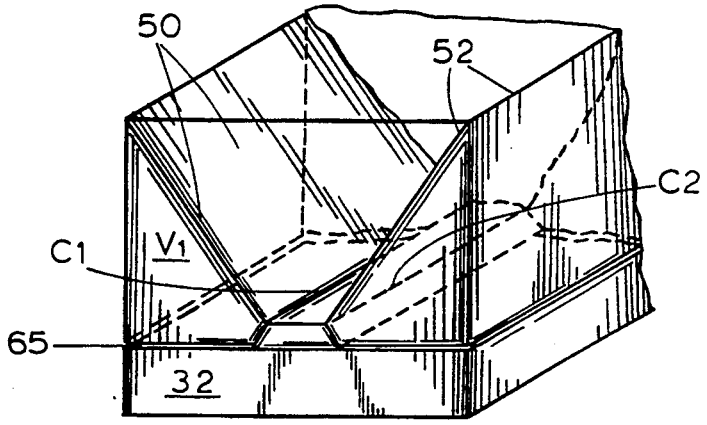
FIG. 4 is a partially broken-away perspective view showing forces applied to a surrounding uncured upper concrete section, by the expansion of the trapezoidally-shaped article of FIG. 1.
Figure 5:
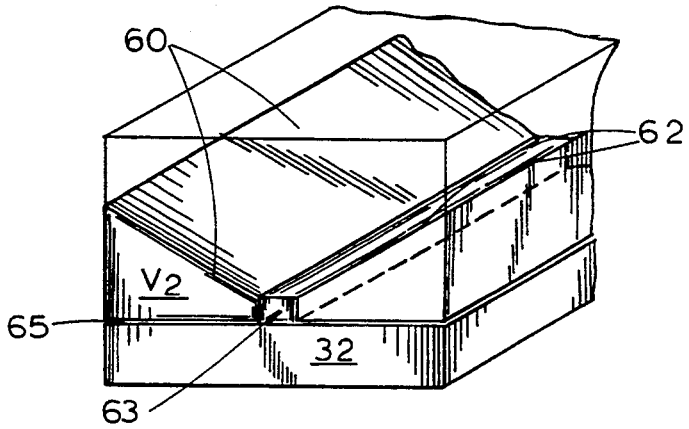
FIG. 5 PRIOR ART
FIG. 5 is a partially broken-away perspective view, similar to FIG. 4, showing forces applied to a smaller area of the same upper concrete section by the expansion of a rectangular-shaped prior art water-sealing article.

Following positioning and optional nailing of the article 12 to an at least partially cured concrete section 32, the second section of concrete 34 is poured to surround article 12, except for its bottom surface 14 in contact with lower concrete section 32, and onto an upper surface, or adjacent a side surface, of concrete section 32 to complete the joint. As shown in FIGS. 4 and 5, the developing expansion forces along planes 50 and 52, resulting when using the water-sealing articles of the present invention, are absorbed along substantially larger planes in the newly poured concrete, and at a substantially more upward angle from the corners $C_1$ and $C_2$ than the forces absorbed along planes 60 and 62, resulting from expansion of a rectangular or square-cornered prior art water-sealing article 63. As a result, expansion of the water seal articles of the present invention will be more easily absorbed by the curing concrete.

In addition, the clay water sealing articles of the present invention will waterproof the concrete joint, preventing water from traversing any spaces 65 (FIGS. 3 and 4) between the concrete sections 32 and 34. Upon hydration, the clay water seal article expands, preferably to many times its non-hydrated volume, to form a water-impenetrable clay seal that completely prevents water from passing through the article.

Figure 6:
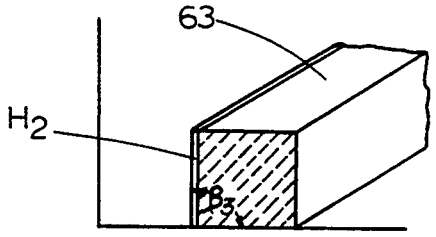
FIG. 6 PRIOR ART
FIGS. 6 and 7 compare initial hydration of the prior art rectangular water-sealing article to hydration of the trapezoidal water-sealing article of the present invention.
Figure 7:
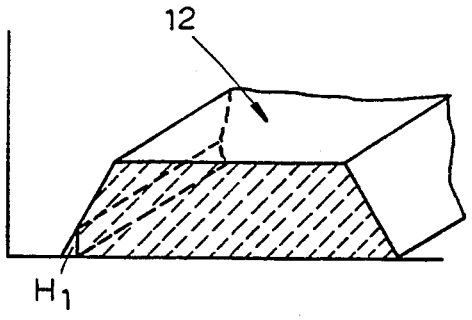

In accordance with another important advantage of the water seal articles of the present invention, the angled lower elongate edges, as shown forming angles $\alpha_1$ and $\alpha_2$ in FIG. 2, are less than 90°, preferably about 45° to about 80°. Hydration of this lower edge at the acute angle $\alpha_1$ and/or $\alpha_2$, upon contact with water, permits the water seal article to hydrate at hydration volume $H_1$, as shown in FIG. 7, hydrating only a lower corner of the product. An article having a 90° lower angle $\alpha_3$, as shown in FIG. 6, permits hydration vertically upwardly, over hydration volume $H_2$, resulting in greater forces acting on the newly formed concrete, along force planes 60 and 62 (FIG. 5) over a smaller newly poured concrete volume $V_2$ (FIG. 5), versus volume $V_1$ for the articles of the present invention.

The clay water seal article of the present invention may be used in all environmental temperatures encountered at the installation location without becoming too stiff or brittle in cold temperatures, and without becoming too soft at higher temperatures. There is no need to heat the water seal article in cold temperatures to give it sufficient flexibility, and the water seal article remains totally flexible over time without shrinking, substantially hardening or oxidizing.

The foregoing detailed description has been given for clearness of understanding only, and no unnecessary limitations should be understood therefrom, as modifications will be obvious to those skilled in the art.

What is claimed is:

1. A plurality of water-sealed concrete sections comprising:

a first section of at least partially cured concrete;

a second section of substantially uncured concrete poured in-situ; and an elongated strip of water-expandable material disposed between said first section and said second section, said strip of water-expandable material having a cross-section in the shape of a trapezium and having an upper corner surrounded by said second concrete section, said upper corner having an included angle of at least 100°.

2. A plurality of water-sealed concrete sections as defined in claim 1, wherein said water-expandable material is in the shape of a trapezoid having a wider base in contact with said first section of concrete, and having a narrower, parallel upper surface surrounded by said second concrete section, wherein at least one upper corner of said trapezoid has an included angle in the range of about 100° to about 150°.

3. A plurality of water-sealed concrete sections as defined in claim 1, wherein said first section is disposed underneath and in contact with said second section.

4. A plurality of water-sealed concrete sections as defined in claim 2, wherein said upper corner of said water-expandable material has an included angle in the range of about 120° to about 140°.

5. A plurality of water-sealed concrete sections as defined in claim 2, wherein said upper corner of said water-expandable material has an included angle of about 110° to about 140°.

6. A plurality of water-sealed concrete sections as defined in claim 5, wherein said upper corner of said water-expandable material has an included angle of about 130°.

7. A plurality of water-sealed concrete sections as defined in claim 1, wherein said water-expandable material is in the shape of a trapezoid having a wider base in contact with said first section of concrete, and having a narrower, parallel upper surface surrounded by said second concrete section, wherein upper corners of said trapezoid have an included angle in the range of about 100° to about 150°.

8. A plurality of water-sealed concrete sections as defined in claim 7, wherein each of said upper corners of said water-expandable material has an included angle in the range of about 120° to about 140°.

9. A plurality of water-sealed concrete sections as defined in claim 7, wherein each of said upper corners of said water-expandable material has an included angle of about 110° to about 140°.

10. A plurality of water-sealed concrete sections as defined in claim 9, wherein each of said upper corners of said water-expandable material has an included angle of about 130°.

11. A method of waterproofing an area of potential water leakage between a plurality of adjacent sections of concrete comprising:

forming a first section of at least partially cured concrete;

disposing a water-swellable clay-containing water sealing article adjacent to and in contact with said first concrete section, said article having a vertical cross-section in the shape of a quadrilateral, having a corner, defined by an intersection of a side surface and an upper surface of said article, with an included angle of at least 100°; and pouring a second section of substantially uncured concrete in contact with said first concrete section and surrounding said corner.

12. A method as defined in claim 11, wherein said article is in the shape of a trapezoid having a wider base in contact with said first section of concrete, and having a narrower, parallel upper surface surrounded by said second concrete section, wherein at least one upper, concrete-surrounded corner of said trapezium has an included angle of at least 100°.

13. A method of waterproofing an area of potential water leakage comprising:

disposing an elongate strip of a shaped, expandable, water-sealing material on an upper surface of a first, at least partially cured, concrete section, said water-sealing material having a shape of a trapezoid wherein an upper corner of said material, defined by an intersection of a side surface and an upper surface of said material, has an included angle of at least 100°; and pouring a second section of substantially uncured concrete adjacent to and in contact with said first section of concrete to substantially cover said corner of said elongate strip.

14. A method as defined in claim 13 and further including the step of nailing said strip to an upper surface of said first section of concrete before pouring said second concrete section.

15. A method as defined in claim 13 wherein said first concrete section and said second concrete section are in vertical alignment.

16. A method as defined in claim 13 wherein said first concrete section and said second concrete section are in horizontal alignment.

17. A method as defined in claim 14, wherein said water-sealing material is in the shape of a trapezoid having a wider base in contact with said first section of concrete, and having a narrower upper surface, parallel to said base, surrounded by said second concrete section, wherein upper corners of said trapezoid have an included angle in the range of about 100° to about 150°.

* * * * *

UNITED STATES PATENT AND TRADEMARK OFFICE

CERTIFICATE OF CORRECTION

PATENT NO. : 5,339,590

DATED : AUGUST 23, 1994

INVENTORS : WILLIAM W. KANGAS

It is certified that error appears in the above-identified patent and that said Letters Patent is hereby corrected as shown below:

Column 2, line 22, delete "Bentonire" and substitute therefor -- Bentonite --;

Column 2, line 22, after "sodium" delete "bentonire," and substitute therefor -- bentonite, --;

Column 2, line 26, after "flow." delete "Bentonire" and substitute therefor -- bentonite --;

Column 2, line 56, after "section(s)" delete "-" and substitute therefor -- . --;

Column 3, line 1, after "water-swellable" delete "bentonire" and substitute therefor -- bentonite --;

Column 3, lines 1 and 2, after "sodium" delete "bentonire," and substitute therefor -- bentonite, --;

Column 3, line 11, after "a" delete "bentonire" and substitute therefor -- bentonite --;

Column 4, lines 6 and 7, after "water-swellable" delete "bentonire" and substitute therefor -- bentonite --;

Column 5, line 22, after "water-swellable" delete "bentonire" and substitute therefor -- bentonite --;

Column 5, line 23, after "sodium" delete "bentonire," and substitute therefor -- bentonite, --;

UNITED STATES PATENT AND TRADEMARK OFFICE

CERTIFICATE OF CORRECTION

PATENT NO. : 5,339,590

DATED : AUGUST 23, 1994

INVENTORS : WILLIAM W. KANGAS

It is certified that error appears in the above-identified patent and that said Letters Patent is hereby corrected as shown below:

Column 6, line 32, after "angles" delete "$\alpha_1$" and substitute therefor -- $\beta_1$ --;

Column 6, line 33, after "and" delete "$\alpha_2$" and substitute therefor -- $\beta_2$ --;

Column 6, line 35, after "angle" delete "$\alpha_1$" and substitute therefor -- $\beta_1$ --;

Column 6, line 35, after "and/or" delete "$\alpha_2$," and substitute therefor -- $\beta_2$, --; and Column 6, line 38, after "angle" delete "$\alpha_3$," and substitute therefor -- $\beta_3$, --.

Signed and Sealed this

Fourteenth Day of November, 1995

*Attest:*

Bruce Lehman

BRUCE LEHMAN

*Attesting Officer*

*Commissioner of Patents and Trademarks*